US009988809B2

(12) United States Patent
Montminy

(10) Patent No.: US 9,988,809 B2
(45) Date of Patent: Jun. 5, 2018

(54) CONSTRUCTION BLOCK ANCHORING SYSTEM

(71) Applicant: Technologie 2000 Inc., Ste-Foy (CA)

(72) Inventor: Marcel Montminy, Ste-Foy (CA)

(73) Assignee: TECHNOLOGIE 2000 INC., Quebec (CA)

( * ) Notice: Subject to any disclaimer, the term of this patent is extended or adjusted under 35 U.S.C. 154(b) by 0 days. days.

(21) Appl. No.: 15/723,348

(22) Filed: Oct. 3, 2017

(65) Prior Publication Data

US 2018/0100314 A1 Apr. 12, 2018

(30) Foreign Application Priority Data

Oct. 6, 2016 (GB) ..... 1616976.5

(51) Int. Cl.

| | |
|---|---|
| ***E02D 35/00*** | (2006.01) |
| ***E04B 1/00*** | (2006.01) |
| ***E04G 21/14*** | (2006.01) |
| ***E04B 1/41*** | (2006.01) |
| ***E04F 13/22*** | (2006.01) |
| ***E04B 2/32*** | (2006.01) |
| ***E04B 2/06*** | (2006.01) |

(Continued)

(52) U.S. Cl.

CPC ..... *E04B 1/4178* (2013.01); *E04B 1/4157* (2013.01); *E04B 2/06* (2013.01); *E04B 2/32* (2013.01); *E04F 13/22* (2013.01); *E04B 1/7637* (2013.01); *E04G 21/201* (2013.01)

(58) Field of Classification Search

CPC ... E04F 13/22; E04F 13/0855; E04F 13/0801; E04F 13/0853; E04F 13/0808; E04B 1/41; E04B 1/4157; E04B 2/06; E04B 2/32; E04B 1/7637; E04B 1/4178; E04B 1/7616

See application file for complete search history.

(56) References Cited

U.S. PATENT DOCUMENTS

| | | | |
|---|---|---|---|
| 1,158,197 | A | 10/1915 | Pinckney |
| 1,331,834 | A | 2/1920 | Weil |

(Continued)

FOREIGN PATENT DOCUMENTS

| | | |
|---|---|---|
| AU | 2004216668 | 4/2006 |
| CA | 2228407 | 9/2005 |

(Continued)

*Primary Examiner* — Brian D Mattei

(57) ABSTRACT

A system for anchoring a wall including superposed rows of construction blocks to an adjacent upstanding structure, each row including a plurality of the construction blocks, the system comprising: an inter-block element insertable between adjacent ones of the construction blocks and securable thereto; and an anchor including an anchoring portion securable to the upstanding structure and a coupler, the coupler securing the anchor and the inter-block element to each other with the anchoring portion at a predetermined distance from the inter-block element and such that with the anchoring portion operatively secured to the upstanding structure and the inter-block element operatively inserted between the adjacent ones of the construction blocks and secured thereto, the anchoring portion and the inter-block element are movable vertically relative to each other over a predetermined range of motion with the anchor remaining secured to the inter-block element. Also a wall including the system.

19 Claims, 5 Drawing Sheets

(51) Int. Cl.
*E04B 1/76* (2006.01)
*E04G 21/20* (2006.01)

(56) References Cited

U.S. PATENT DOCUMENTS

| | | | | | |
|---|---|---|---|---|---|
| 1,334,101 | A | | 3/1920 | Kealy | |
| 1,499,171 | A | | 6/1924 | Green | |
| 1,941,436 | A | | 12/1933 | Haupt | |
| 2,103,569 | A | | 12/1937 | Wallace | |
| 2,239,127 | A | | 4/1941 | Swenson | |
| 2,674,872 | A | | 4/1954 | Grund | |
| 2,687,034 | A | | 8/1954 | Blanc | |
| 2,708,359 | A | | 5/1955 | Henry | |
| 2,856,766 | A | | 10/1958 | Huntley | |
| 3,196,581 | A | | 7/1965 | Castelli | |
| 3,293,810 | A | | 12/1966 | Monroe | |
| 3,374,589 | A | | 3/1968 | Neal, Jr. | |
| 3,398,495 | A | | 8/1968 | Petty | |
| 3,426,497 | A | | 2/1969 | Mundy | |
| 3,501,877 | A | | 3/1970 | White | |
| D246,573 | S | | 12/1977 | White | |
| 4,095,384 | A | | 6/1978 | Zarriello | |
| 4,136,498 | A | | 1/1979 | Kanigan | |
| 4,334,397 | A | | 6/1982 | Hitz | |
| 4,473,984 | A | * | 10/1984 | Lopez | E04B 2/94 411/397 |
| 4,765,108 | A | * | 8/1988 | Lapish | E04B 1/41 248/231.91 |
| 4,959,937 | A | * | 10/1990 | Mayer Emil | E04L 32/06 403/403 |
| 5,035,099 | A | * | 7/1991 | Lapish | E04F 13/0808 52/565 |
| 5,067,292 | A | * | 11/1991 | Finean | E04B 2/92 51/126.4 |
| D352,655 | S | | 11/1994 | Anderson et al. | |
| 5,598,673 | A | | 2/1997 | Atkins | |
| 5,671,578 | A | * | 9/1997 | Hohmann | E04B 1/4178 52/562 |
| 5,802,792 | A | * | 9/1998 | Fielding | E04L 32/08 52/396.08 |
| 6,000,186 | A | | 12/1999 | Fielding | |
| 6,131,360 | A | | 10/2000 | Dalen | |
| 6,279,283 | B1 | * | 8/2001 | Hohmann | E04B 1/4178 52/378 |
| 6,668,505 | B1 | * | 12/2003 | Hohmann | E04B 1/4178 52/379 |
| D575,633 | S | | 8/2008 | Thornton | |
| D580,260 | S | | 11/2008 | Collins et al. | |
| 7,587,870 | B2 | | 9/2009 | Voegele, Jr. et al. | |
| 13,096,090 | | | 1/2012 | Hohmann, Jr. et al. | |
| 13,201,374 | | | 6/2012 | Hohmann, Jr. | |
| D663,044 | S | | 7/2012 | Tancredi | |
| 13,347,581 | | | 1/2013 | Doerr et al. | |
| 13,621,802 | | | 1/2014 | Spyrou | |
| 9,200,444 | B2 | * | 12/2015 | Ra | E04B 2/90 |
| 2004/0216413 | A1 | * | 11/2004 | Hohmann | E04B 1/4178 52/506.01 |
| 2013/0232909 | A1 | * | 9/2013 | Curtis | E04B 1/4178 52/704 |
| 2013/0247495 | A1 | | 9/2013 | Tancredi | |
| 2016/0032582 | A1 | * | 2/2016 | Hohmann, Jr. | E04B 1/4178 52/703 |

FOREIGN PATENT DOCUMENTS

| | | |
|---|---|---|
| CA | 2597733 | 8/2006 |
| DE | 2610655 | 1/1978 |
| EP | 625617 | 11/1994 |
| EP | 833014 | 4/1998 |
| EP | 2108754 | 10/2009 |
| EP | 2958956 | 10/2011 |
| EP | 2989981 | 11/2013 |
| GB | 276099 | 8/1927 |
| GB | 2247908 | 3/1992 |
| GB | 2300869 | 11/1996 |
| GB | 2323394 | 9/1998 |
| GB | 2441604 | 3/2008 |
| JP | 2000144974 | 5/2000 |
| TW | M392836 | 11/2010 |
| WO | 1982003419 | 10/1982 |
| WO | 2002090688 | 11/2002 |
| WO | 2005080707 | 9/2005 |

* cited by examiner

CONSTRUCTION BLOCK ANCHORING SYSTEM

FIELD OF THE INVENTION

The present invention relates to the general field of construction, and is more specifically concerned with a construction block anchoring system.

BACKGROUND

Block wall constructions, particularly the type of block wall constructions anchored to a wall support structure of a building, such as facade or veneer brick walls and the likes that are used for protection, durability and aesthetically purposes, are well known in the general field of masonry works. Such block wall constructions are typically mounted parallelly in a spaced apart relationship in front of the wall support structure by laying and bonding with mortar superposed rows, or courses, of construction blocks, such as bricks, until a predetermined height is reached, such as the next floor level of the building.

At that point, an elongated anchor member made of metal is positioned horizontally along with mortar on an elongated top portion of the block wall construction, and rigidly anchored along a rear portion thereof with the wall support structure using suitable attachment means such wood lag screws, nut and bolts, or the likes.

Then the block wall construction resumes with more rows of construction blocks and mortar until the next floor level is reached, where another anchor member is installed, and so on.

While this block wall construction and method is largely known and used across the world for providing facade and veneer brick walls, it is also largely known for its disadvantages. For example, in parts of the world in which temperature varies between below and above freezing temperatures, the foundation on which is erected the block wall construction may slightly move relative to the wall support structure due to the cyclical freezing and thawing of the ground every winter and spring seasons. Thus, often no more than a few years after the completion of the wall, cracks and the propagation thereof start to appear as seen along the outer surface of the block wall construction, particularly near the anchor members since these are rigidly tied to the more stable wall support structure.

These cracks are then often aggravated due to the infiltration of moisture and rain water which, in turn, freezes and worsens the gap of the cracks. At one point, parts of the block wall constructions may start to crumble and fall on a street walk below and cause damages or injuries.

Such block wall constructions further have an aesthetic disadvantage in that a front longitudinal portion of the anchor members embedded between selected rows thereof are often apparent along the otherwise uniform veneer brick walls of a building.

Against this background, there exists a need in the construction industry to provide an improved system for anchoring construction blocks to a building. An object of the present invention is therefore to provide such an improved device.

SUMMARY OF THE INVENTION

In a broad aspect, there is provided a system for anchoring construction blocks to an adjacent structure, and a method of using same.

In an other broad aspect, there is a system for anchoring a wall including superposed rows of construction blocks to an adjacent upstanding structure, each row including a plurality of the construction blocks, the system including: an inter-block element insertable between adjacent ones of the construction blocks and securable thereto; and an anchor including an anchoring portion securable to the upstanding structure and a coupler, the coupler securing the anchor and the inter-block element to each other with the anchoring portion at a predetermined distance from the inter-block element and such that with the anchoring portion operatively secured to the upstanding structure and the inter-block element operatively inserted between the adjacent ones of the construction blocks and secured thereto, the anchoring portion and the inter-block element are movable vertically relative to each other over a predetermined range of motion with the anchor remaining secured to the inter-block element.

There may also be provided a system wherein the anchor includes an anchoring element, the anchoring portion being part of the anchoring element, the anchoring element including a coupling portion opposed to the anchoring portion, the coupler being removably secured to the coupling portion.

There may also be provided a system wherein the inter-block element is substantially plate-shaped and defines opposed top and bottom surfaces and a peripheral edge.

There may also be provided a system wherein the inter-block element defines a body and a tongue protruding from the body, the tongue defining a tongue coupling aperture extending therethrough between the top and bottom surfaces, and wherein, with the inter-block element operatively inserted between adjacent ones of the construction blocks and operatively secured thereto, the body is inserted between the adjacent ones of the construction blocks and the tongue protrudes from the adjacent ones of the construction blocks, the coupler being inserted through the tongue coupling aperture.

There may also be provided a system wherein the coupler is vertically slidable relative to the tongue coupling aperture.

There may also be provided a system wherein the coupling portion defines a vertically extending coupling portion aperture and the coupler includes a stem extending substantially vertically downwardly from a head, the stem being inserted in the coupling portion aperture and slidably inserted through the tongue coupling aperture, the head being larger than the coupling portion aperture and the head being above the coupling portion aperture.

There may also be provided a system wherein the coupling portion aperture is threaded, the coupling portion aperture and the tongue coupling aperture being vertically aligned relative to each other, the stem being threaded, the stem threadedly engaging the coupling portion aperture and the stem being slidable along the tongue coupling aperture.

There may also be provided a system wherein the inter-block element defines a body and at least two tongues protruding from the body in a spaced apart relationship relative to each other, the coupler including a link secured to the two tongues and defining a link aperture extending vertically therethrough between the two tongues, wherein, with the inter-block element operatively inserted between adjacent ones of the construction blocks and operatively secured thereto, the body is inserted between the adjacent ones of the construction blocks and the tongues and link protrude from the adjacent ones of the construction blocks, the coupler including a stem extending substantially vertically downwardly from a head, the stem being inserted in the coupling portion aperture and through the link aperture, the head being larger than the link aperture and the head being above the link.

There may also be provided a system wherein the inter-block aperture defines at least one bonding aperture extending between the top and bottom surface for inserting a bonding material thereinto to bind the two adjacent ones of the construction blocks to each other with the inter-block element therebetween.

There may also be provided a system wherein the bonding aperture defines a neck at a location intermediate the top and bottom surfaces.

There may also be provided a system wherein the body further defines draining apertures extending between the top and bottom surfaces.

There may also be provided a system wherein the bottom surface defines draining channels extending therealong in fluid communication with at least one of the draining apertures, the draining channels being open at the peripheral edge.

There may also be provided a system wherein at least part of the peripheral edge is corrugated.

There may also be provided a system wherein the anchoring and coupling portions are made of different metals having different galvanic potentials, the anchor element further comprising an intermediate portion provided between the anchoring and coupling portions separating the anchoring and coupling portions from each other.

There may also be provided a system wherein the anchoring portion is threaded and screwable to the adjacent structure.

In another broad aspect, there is provided a building including: an upstanding structure defining a substantially vertical upstanding structure face; and a wall made of superposed rows of construction blocks erected substantially parallel to the upstanding structure face, the wall including a plurality of rows, each row including a plurality of construction blocks, the wall including an inter-block element inserted between two adjacent ones of the construction blocks, each in a respective one of the rows, and secured thereto; and an anchor including an anchoring portion secured to the upstanding structure and a coupler, the coupler securing the anchor and the inter-block element to each other with the anchoring portion at a predetermined distance from the inter-block element; wherein the anchoring portion and the inter-block element are movable vertically relative to each other over a predetermined range of motion with the anchor remaining secured to the inter-block element.

There may also be provided a building wherein the anchor includes an anchoring element, the anchoring portion being part of the anchoring element, the anchoring element including a coupling portion opposed to the anchoring portion, the coupler being secured to the coupling portion; and the inter-block element is substantially plate-shaped and defines opposed top and bottom surfaces and a peripheral edge, the inter-block element defining also a body and a tongue protruding from the body, the tongue defining a tongue coupling aperture extending therethrough between the top and bottom surfaces, the body being inserted between the rows and the tongue protruding from the wall between the wall and the upstanding structure face, the coupler being inserted through the tongue coupling aperture and vertically slidable relative thereto.

There may also be provided a building wherein the coupling portion defines a vertically extending coupling portion aperture and the coupler includes a head and a stem extending substantially vertically downwardly from the head, the stem being inserted in the coupling portion aperture, the head being larger than the coupling portion aperture.

There may also be provided a building wherein the body defines at least one bonding aperture extending vertically therethrough, the wall further comprising a bonding material in the at least one bonding aperture, the bonding material being bound to the two adjacent ones of the construction blocks.

There may also be provided a building wherein the wall includes a plurality of the inter-block elements and a plurality of horizontal and vertical spacing elements provided between the construction blocks, the inter-block elements and the horizontal and vertical spacing elements having a front end that is short of a front surface of the wall, the wall also including a bonding material provided in front of the inter-block elements and the horizontal and vertical spacing elements between the construction blocks.

Advantageously, in some embodiments, the present invention discloses a device and method for spacing and anchoring a block wall construction to an adjacent structure wherein the block wall construction can be mortarless, that self-drain itself of any moisture or rain water infiltration, and which allows a relative vertical movement between the wall and the adjacent structure. Hence, the present invention advantageously provide facades and veneer brick wall constructions that are significantly less prone to cracks, crack propagations or, worse, crumbling down hazardously on a crowded sidewalk, than known devices and methods of the prior art.

The present application claims benefit from UK request application 1616976.5 filed Oct. 6, 2016, the contents of which is hereby incorporated by reference in its entirety.

Other objects, advantages and features of the present invention will become more apparent upon reading of the following non-restrictive description of some embodiments thereof, given by way of example only with reference to the accompanying drawings.

BRIEF DESCRIPTION OF THE DRAWINGS

FIG. 12, in a side environmental view, illustrates the guide tool of FIG. 10, here shown engaged between two construction blocks for setting the horizontal spacing there between;

DETAILED DESCRIPTION

The term "substantially" is used throughout this document to indicate variations in the thus qualified terms. These variations are variations that do not materially affect the manner in which the invention works and can be due, for example, to uncertainty in manufacturing processes or to small deviations from a nominal value or ideal shape that do not cause significant changes to the invention. These variations are to be interpreted from the point of view of the person skilled in the art.

Directional terminology, such as right, left, top, bottom, forward and backward, among others, refers to the orientation relative to an upstanding wall on level ground. This terminology is used for clarity reasons and should not be used to restrict the scope of the claims unless explicitly claimed.

Broadly, the present patent application concerns systems and parts thereof that allow anchoring construction block walls, such as brick walls, to adjacent structures so that the construction block wall can move vertically relative to the adjacent structure while remaining anchored thereto. While the present patent application describes the system in use with a specific type of construction blocks, namely bricks, the system is usable with any other type of construction blocks. In some embodiments, spacing elements may be also used. However, use of the system without the spacing elements is also within the scope of the invention. In some embodiments, the system and the spacing elements together allow construction of a construction block wall, such as a brick wall, that replaces the conventional layer of mortar between adjacent rows of the wall and between the construction blocks within each row with inter-block elements and spacing elements, made for example, and non-limitingly, of a polymer, and a bonding material.

Figure 2:
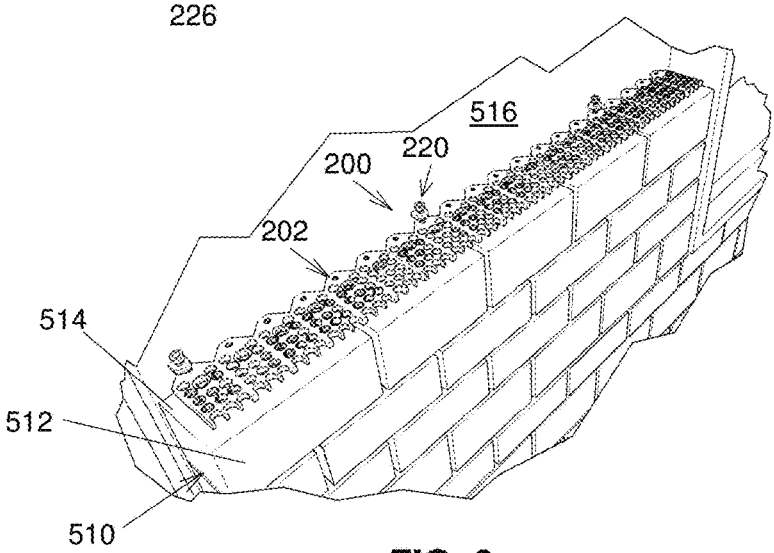
FIG. 2, in a front perspective view, illustrates a wall incorporating the system of FIG. 1, here shown mounted on a top surface portion of a row of construction blocks in the form of bricks, and anchored to a wall support structure extending vertically adjacently behind the wall.
Figure 3:
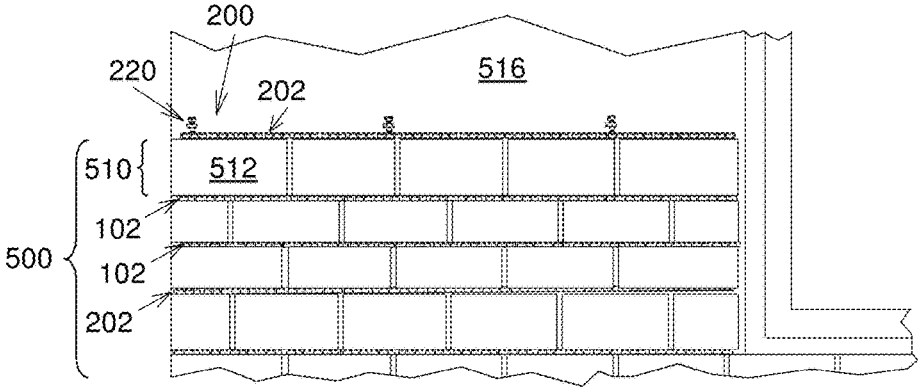
FIG. 3, in a front elevation environmental view, illustrates the system of FIG. 1.

FIG. 3 illustrates a wall 500 including superposed rows 510 of construction blocks 512. The wall 500 includes an horizontal spacing element 102, better seen in FIGS. 4 and 5, made of a substantially rigid material and having a generally planar configuration and extending horizontally so as to cover at least a portion of a top surface 514 of at least one construction block 512. For example, and non-limitingly, the horizontal spacing element 102 has a surface area that is substantially equal to the surface area of the top surface 514. The wall 500 also includes a system 200, better seen in FIGS. 1 and 2, for example, for anchoring the wall 500 to an adjacent upstanding structure 516. It should be noted that in some embodiments, the system 200 is usable in a wall in which the horizontal spacing elements 102 are omitted and replaced, for example, by a conventional mortal layer.

Figure 1:
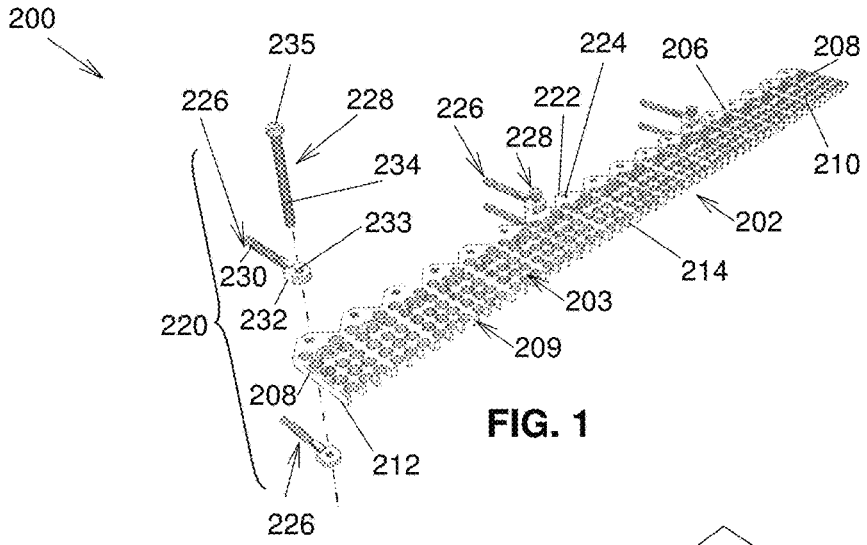
FIG. 1, in a front perspective, exploded view, illustrates an embodiment of a system for anchoring a wall including superposed rows of construction blocks to an adjacent upstanding structure, according to an embodiment of the present invention.

Referring to FIG. 1, the system 200 includes an inter-block element 202 insertable between adjacent ones of the construction blocks 512 (not shown in FIG. 1) and securable thereto. The system 200 also includes an anchor 220. In some embodiments, the anchor 220 includes at least one, and typically two, anchor elements 226 each defining opposed anchoring and coupling portions 230 and 232. The anchoring portion 230 is securable to the upstanding structure 516. A coupler 228 is secured to the inter-block element 202 and to the coupling portion 232. In some embodiments, the coupler 228 is removably secured to the coupling portion 232. However, in other embodiments, the coupler 228 and coupling portion 232 are integrally formed, or permanently coupled such as through welding. The coupler 228 secures the anchor element 226 and the inter-block element 202 to each other with the anchoring portion 230 at a predetermined distance from the inter-block element 202 and such that with the anchoring portion 230 operatively secured to the upstanding structure 516 and the inter-block element 202 operatively inserted between the adjacent ones of the construction blocks 512 and secured thereto, the coupling portion 232 and the inter-block element 202 are movable vertically relative to each other over a predetermined range of motion.

Figure 4:
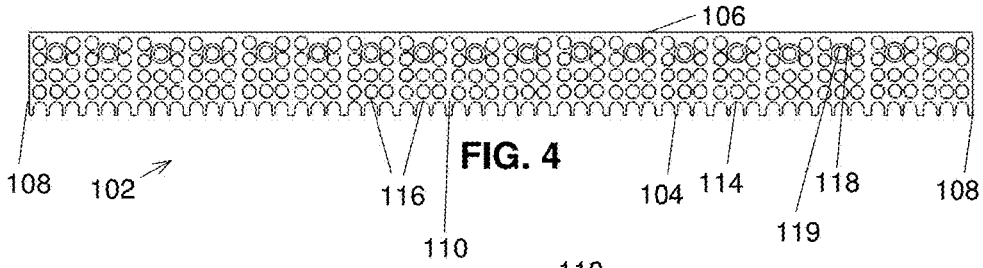
FIG. 4, in a top plan view, illustrates an embodiment of a spacing element usable in the wall of FIG. 2.
Figure 5:
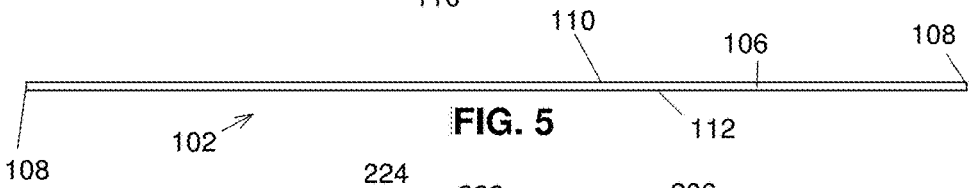
FIG. 5, in a rear elevational view, illustrates the spacing element of FIG. 4.
Figure 6:
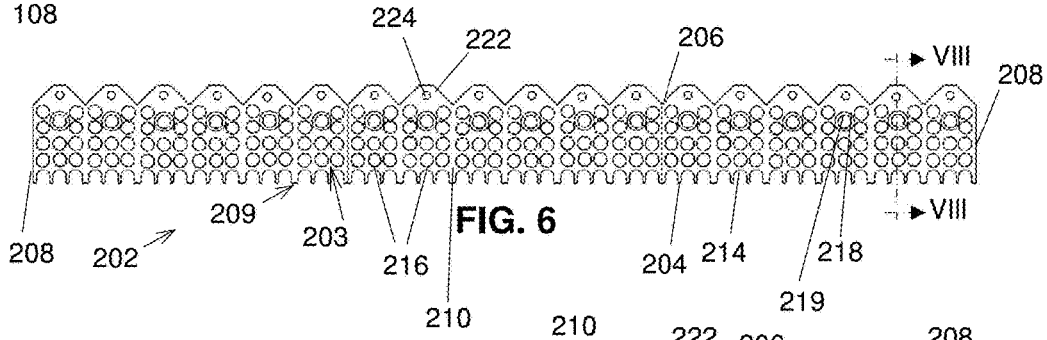
FIG. 6, in a top plan view, illustrates an inter-block element part of the system of FIG. 1.

Referring to FIG. 4, the horizontal spacing element 102 defines a spacing element front edge 104 and a spacing element rear edge 106 joined by a pair of spacing element side edges 108. The horizontal spacing element 102 further includes parallelly extending spacing element top and bottom surfaces 110 and 112 respectively, that are spaced apart a spacing element thickness dimension, as seen in FIG. 5.

Figure 13:
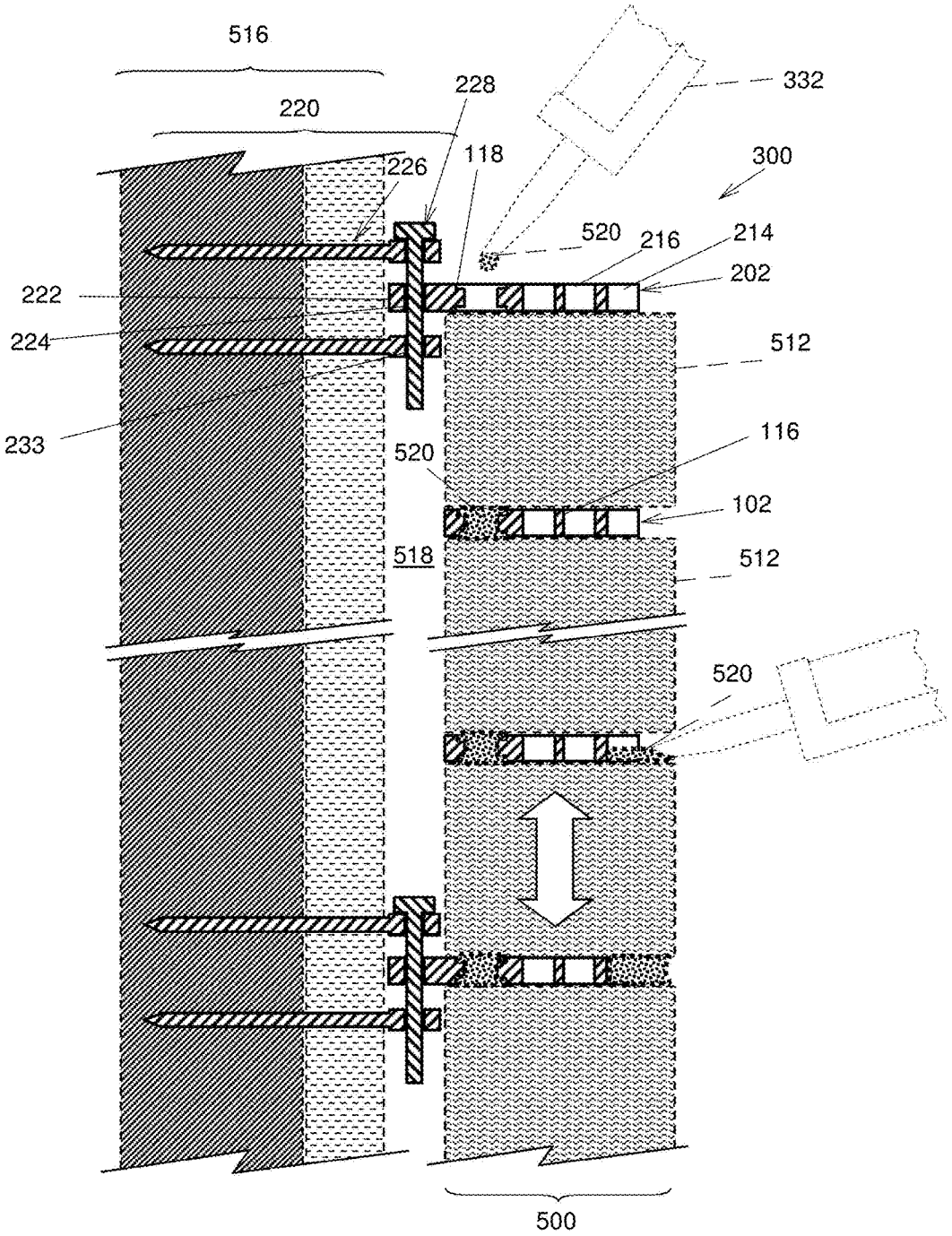
FIG. 13, in a side cross-sectional, environmental view, illustrates the wall of FIG. 2, which incorporate the system of FIG. 1 and the spacing element of FIG. 4.

Returning to FIG. 4, the horizontal spacing element 102 defines at least one corrugated portion 114 extending longitudinally along at least one of the spacing element front, rear and side edges 104, 106 and 108, for receiving and engaging a bonding material 520 applied therealong once the horizontal spacing element 102 is positioned between two superposed rows 510 of construction blocks 512, as seen in FIG. 13. The bonding material 520 may be, for example, a suitable brick sealant applied with a caulking gun 322 or, alternatively, a suitable mortar applied with a trowel, among other possibilities. Furthermore, as would be obvious to someone familiar with the art of masonry, such brick sealant or mortar is also, in some embodiments, applied in the vertical space between each adjacent construction block 512 in a horizontal row 510.

In some embodiments, the corrugated portion 114 extends longitudinally along the at least one edge of the horizontal spacing element 102 in the form of a series of teeth distributed in an equidistantly spaced apart relationship therealong and oriented perpendicularly relative to the at least one spacing element edge. For example, the corrugated portion 114 extends substantially the whole length of the spacing element front edge 104, as illustrated in FIG. 4. It is to be understood that the corrugated portion 114 may extend along more than one edge of the horizontal spacing element 102, as explained in further details hereinbelow with respect to the inter-block element 202.

Returning to FIG. 4, in some embodiments, the horizontal spacing element 102 further defines at least one draining aperture 116 extending vertically therethrough between the spacing element top and bottom surfaces 110 and 112 thereof, for allowing any presence of moisture or rain water that may have infiltrated in the wall 500 to drain out mainly along the spacing element rear edge 106. The horizontal spacing element 102 further typically defines at least one bonding aperture 118 also extending vertically therethrough for receiving therein a bonding material 520 (not seen in FIG. 4).

In some embodiments, the horizontal spacing element 102 defines a plurality of equally sized and spaced apart draining apertures 116 distributed along a substantial portion of the planar configuration of the horizontal spacing element 102. Furthermore, in some embodiments, a suitable number and size of draining apertures 116 are spaced apart from one another a distance that is at least slightly less than the radius of each one thereof. Other configuration and disposition for the draining apertures 116 are also possible.

In some embodiments, the at least one bonding aperture 118 defines top and bottom opening portions at each end thereof having each a relatively greater radius than an intermediate portion of the bonding aperture 118 that is extending vertically therebetween. In other words, the bonding aperture 118 defines a neck 119 at a location intermediate the top and bottom surfaces 110 and 112.

In some embodiments, as seen in FIG. 4, the horizontal spacing element 102 defines a plurality of equally sized bonding apertures 118 distributed serially in an equidistantly spaced apart relationship along an axis extending parallelly adjacently the spacing element rear edge 106. As can be observed in FIG. 4, two adjacent bonding apertures 118 may be separated by one or more draining apertures 116. Other configuration and disposition for the bonding apertures 118 along the horizontal spacing element 102 are also possible.

Typically, the horizontal spacing element 102 thickness dimension is equal to a typical vertical spacing dimension commonly used in the masonry industry between two superposed rows 510 of the construction blocks 512 for a given format, dimension and weight of construction blocks. Other relative thickness dimensions for the horizontal spacing element 102 are also possible.

The horizontal spacing element 102 may have a length dimension between the spacing element side edges 108 that is roughly equivalent to the length of a typical brick, or the length of a typical concrete block, for example twelve inches (about 30.5 cm), four feet (1.22 meters) or eight feet (about 2.44 meters). Other relative length dimensions for the horizontal spacing element 102 are also possible. The horizontal spacing element 102 is made of a substantially rigid material, or combination of materials having suitable load compression, ductility and wide range thermal stability characteristics. For example, the horizontal spacing element 102 is a one piece element made of a suitable polymeric material that meets these characteristics. Other known rigid materials meeting these characteristics are also possible.

In some embodiments, the spacing element front and rear edges, 104 and 106 respectively, each have a longitudinal shape suitably configured such that, when the horizontal spacing element 102 is positioned on top of the at least one construction block 512, the spacing element rear edge 106 typically extends parallelly in register with the top rear edge of the at the at least one construction block 512, while the spacing element front edge 104 extends parallelly in an adjacently inwardly spaced apart relationship relative to the top front edge of the at least one construction block 512.

Typically, the spacing element front and rear edges, 104 and 106 of the horizontal spacing element 102 are suitably configured for one or more regular shaped bricks having each a rectangular shaped top surface 514. Other shapes of construction blocks 512 are also possible such as a custom shaped masonry block or brick having a top surface with a profiled front edge.

Figure 7:
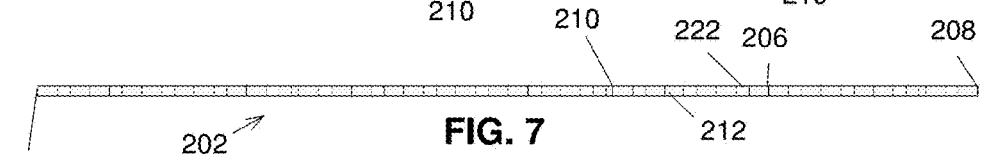
FIG. 7, in a rear elevational view, illustrates the inter-block element of FIG. 6.

FIGS. 1 to 3, 6 and 7 illustrate various aspects of the system 200. The system 200 includes the inter-block element 202. The inter-block element 202 is in some embodiments substantially similar to the horizontal spacing element 102, except that it includes tongues 222. More specifically, with reference to FIG. 6, the inter-block element 202 has inter-block element front and rear edges 204 and 206, inter-block element side edges 208, which together define a peripheral edge 209, and inter-block element top and bottom surfaces 210 and 212 (as seen in FIG. 7). The inter-block element 202 also defines at least one corrugated portion 214 extending longitudinally along at least one of the inter-block element front, rear and side edges 204, 206 and 208, at least one drainage aperture 216, and at least one bonding aperture 218. These elements, except for the shape of the inter-block element 202 at the inter-block element rear edge 206, are similar to the corresponding elements in the horizontal spacing element 102.

Figure 9:
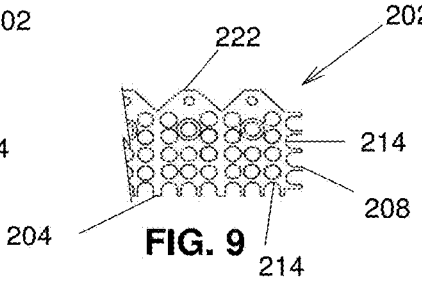
FIG. 9, in a top plan, partial view, illustrates yet another embodiment of an inter-block element, according to the present invention.

In some embodiments, as illustrated through another embodiment of an inter-block element 202' in FIG. 9, a corrugated portion 214 may extend along an inter-block element front edge 204 and one or both inter element side edges 208 in order to extend along a positive corner in the wall 500. This variant is also possible in the horizontal spacing element 102.

Figure 8:
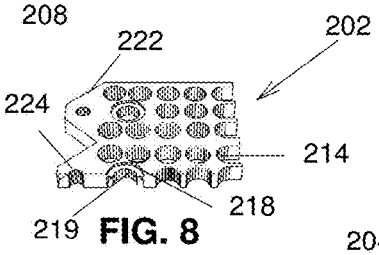
FIG. 8 in a top perspective, cross-sectional view along section line VIII-VIII of FIG. 6, illustrates the inter-block element of FIG. 6.

Also, FIG. 8 better illustrates an example of a shape that the bonding aperture 218 may take. The bonding aperture 218 is not of constant cross-sectional transversal area, but instead defines a neck 219 along a portion thereof. The bonding aperture 118 may have a similar shape.

In some embodiments, the main difference between the inter-block element 202 and the horizontal spacing element 102 resides in that inter-block element 202 is securable to the anchor element 226 using the coupler 228 so as to be able to anchor the inter-block element 202, and thus the wall 500, to the upstanding structure 516 extending typically vertically adjacently in a spaced apart relationship behind the wall 500, as best illustrated in FIG. 13.

To that effect, with reference to FIG. 1, the inter-block element 202 defines a body 203, which is for example similar in shape and structure to the horizontal spacing element 102, and at least one tongue 222 protruding from the body 203. The coupler 228 is used to secure the anchor element 226 to the tongue 222. In a non-limiting embodiment of the invention, the tongue 222 defines a tongue coupling aperture 224 extending therethrough, typically substantially vertically, between the inter-block element top and bottom surfaces 210 and 212. With the inter-block element 202 operatively inserted between adjacent ones of the construction blocks 512 and operatively secured thereto, the body 203 is inserted between the adjacent ones of the construction blocks 512 and the tongue 222 protrudes from the adjacent ones of the construction blocks 512. The coupler 228 is inserted through the tongue coupling aperture 224 so that the coupler 228 is vertically slidable relative to the tongue coupling aperture 224. The tongue 222 typically extends horizontally from the inter-block element rear edge 206 a distance that is at least slightly less than a typical distance 518 between the block wall construction 500 and the adjacent upstanding structure 516, as best illustrated in FIG. 13.

Typically, but not necessarily a plurality of tongues 222, each with a tongue coupling aperture 224, may occupy substantially the whole length of the inter-block element rear edge 206 in a side by side configuration. This arrangement of tongues 222 and tongue coupling apertures 224 are for maximizing the corresponding occurrences with spaced apart positions of support beams within the adjacent upstanding structure 516, which are not always at regular interval positions therealong. In use, the anchor element 226 has its anchoring portion 230 rigidly engaged with the adjacent upstanding structure 516.

Referring for example to FIG. 1, the anchor 220 includes for example a pair of anchor elements 226 positioned vertically spaced apart from each other. Each anchoring portion 230 is engaged in the adjacent upstanding structure 516 so as to have their respective coupling portion 232 in register one above the other along a vertical axis and aligned with the tongue coupling aperture 224. For example, each anchor element 226 defines in the coupling portion 232 a respective coupling portion aperture 233, which is vertically aligned with the tongue coupling aperture 224. A non-limiting example of such an anchor element 226 would be an eye lag screw. However, any other suitable anchor element 226 is usable in the present invention.

The coupler 228 includes a stem 234 and is typically terminated at the top by a head 235 of a larger diameter than the stem 234. In some embodiments, the coupling portion apertures 233 are such that the stem is slidably engaging along the vertical axis the coupling portion aperture 233 of each anchor element 226, which are interposed by the tongue coupling aperture 224. The head 235 is above the coupling portion aperture 233. A non-limiting example of such a coupler 228 would be a suitably sized screw or bolt. However, any other suitable coupler 228 is usable in the present invention. In other embodiments, one or both coupling portion apertures 233 and the stem 234 may be compatibly threaded so as to have a threaded engagement therebetween, yet allowing the inter-block element 202 to slidably move vertically relative thereto.

As would be obvious to someone familiar with hardware components, other known equivalent assembly providing a vertically movable anchor are also possible. For example (not shown in the drawings), a single square screw hook (e.g. a lag screw having a right angle stem as a head portion), may be used as a combination anchor element 226 and coupler 228, with the right angle stem acting as the coupler 228. Thus, the anchor 220 may be made of a single integral piece of material in some embodiments.

With the system 200, the wall 500 may at least slightly move vertically relative to the more stable adjacent upstanding structure 516 due to a thermal difference between them and/or their respective foundations, such as when the ground swells at below freezing temperatures. Hence, damage to the wall 500, including its brick sealant 520 or mortar joints, may be reduced or avoided when compared to known methods and technologies commonly used to erect a block wall construction.

Figure 10:
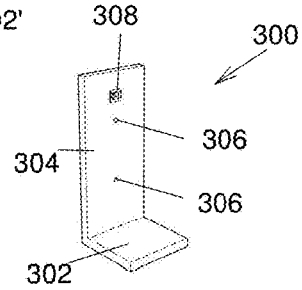
FIG. 10, in a front perspective view, illustrates a guide tool usable in the assembly of the wall of FIG. 2.

In some embodiments, the system 200 may further comprise a guide tool 300. Referring to FIG. 10, the guide tool 300 has a generally L-shaped configuration that includes a first planar portion 302. The first planar portion 302 has a suitable shape configuration and thickness that are generally corresponding to the vertical space between two horizontally adjacent construction blocks 512 in a row 510 in the wall 500.

Figure 12:
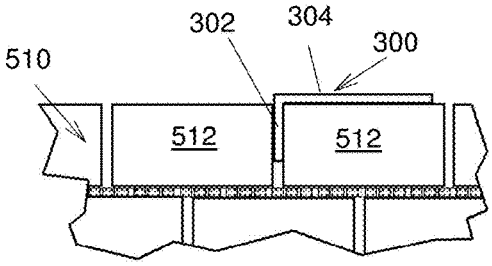

Thus, the first planar portion 302 may be conveniently used for horizontally spacing two adjacent construction blocks 512 in a row 510, as illustrated in FIG. 12.

The guide tool 300 further includes a second planar portion 304 extending perpendicularly from one end of the first planar portion 302 a distance that is at least slightly greater than the sum of the vertical dimension of a construction block 512 and the predetermined distance of the anchor element 226 above the tongue coupling aperture 224 of a inter-block element 202 positioned on the top surface 514 of the construction block 512.

Figure 11:
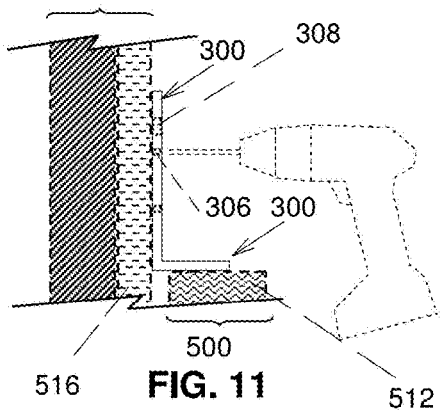
FIG. 11, in a side environmental view, illustrates the guide tool of FIG. 10, here shown engaged with a top row of construction blocks and a wall support structure for drilling pilot holes at predetermined positions in the wall support structure.

The second planar portion 304 defines a pair of vertically spaced apart guide tool apertures 306 extending perpendicularly therethrough. The pair of guide tool apertures 306 are positioned such that they are in register with the vertical position of each one in the pair of anchor elements 226 above and below of an inter-block element 202 to be positioned on top of a next row 510 of construction blocks 512, when the guide tool 300 has its first planar portion 302 resting coplanarly on top of the previous, or underlying row 510, as illustrated in FIG. 11.

Thus, the second planar portion 304 may be conveniently used for drilling suitably positioned pilot holes through each guide tool aperture 306 thereof and into the adjacent upstanding structure 516, for anchoring the inter-block element 202 that will be positioned on top of the next row of construction blocks 512 to be mounted.

In some embodiments, the guide tool 300 further includes a spirit level element 308 embedded in an aperture extending perpendicularly through the second planar portion 304 and is configured for indicating the true vertical level of the pair of guide tool apertures 306 before drilling the pilot holes.

With reference to FIGS. 2, 3 and 13, an exemplary method of use of the present invention will now be described. In a first step, a row 510 of construction blocks 512 is positioned in a conventional manner, for example, along the top surface of a building foundation or, alternatively, a previously layered down row 510 of construction blocks 512, and in a parallelly adjacent spaced apart relationship relative to the upstanding structure 516.

In a second step, a sufficient number of horizontal spacing elements 102 are positioned end to end and in register on the top surfaces 514 of the construction blocks 512 of the row 510 such that the corrugated portions 114 thereof are oriented away from the upstanding structure 516. In a third step, each one of the bonding aperture 118 is slightly overfilled with a suitable bonding material 520. In a fourth step, the first, second and third steps are repeated in sequence until a predetermined height is reached such as, for example, and non-limitingly, about two feet high (about 61 cm).

In a fifth step, the guide tool 300 is used to drill pairs of vertically corresponding pilot holes at suitably spaced apart positions in the upstanding structure 516 above the top row 510 of construction blocks 512, followed with suitably engaging an anchor element 226 in each pilot hole with its coupling portion aperture 233 oriented vertically. In a sixth step, a sufficient number of inter-block elements 202 are positioned end to end and in register on the top surfaces 514 of the last row 510 of construction blocks 512 such that the corrugated portions 214 thereof are oriented away from the upstanding structure 516. In a seventh step, a coupler 228 is engaged through each pairs of vertically corresponding coupling portion aperture 233, with the tongue coupling aperture 224 of the corresponding inter-block element 202 in between. In an eight step, each one of the bonding apertures 218 is slightly overfilled with a suitable bonding material. In a ninth step, the first to seventh steps are repeated until the block wall construction 500 has reached a desired height.

In a tenth step, a suitable bonding material such as a brick sealant or mortar is used for filling both the vertical and horizontal interstitial front spaces between the construction blocks 512 so as to fill, bond and, thus, seal these spaces, and also to obtain the look of a finished brick wall construction. As would be obvious to someone familiar with masonry work, the tenth step may be executed more often between previous steps of the method as construction of the wall 500 progresses in height. Furthermore, during the laying of a row of construction blocks 512, a bonding material may be applied in a conventional manner between the opposed side surfaces of each construction block 512 as it is added to the horizontal row 510 of construction blocks 512. Furthermore, it is to be understood that the height dimension between two rows 510 where inter-block elements 202 with anchors 220 are used may have other height dimension values, which is generally a factor of the building block format, size and weight.

Figure 14:
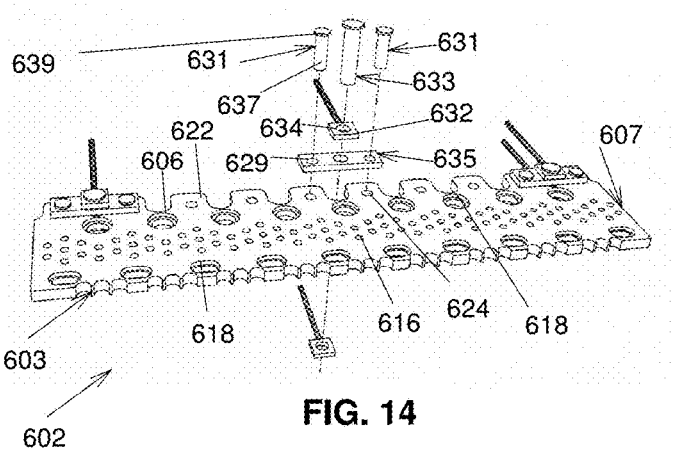
FIG. 14, in perspective exploded view, illustrates a system for anchoring a wall including superposed rows of construction blocks to an adjacent upstanding structure according to an alternative embodiment of the present invention.

Referring to FIG. 14, there is shown a system 600 according to an embodiment of the present invention. The system 600 is similar in many respects to the system 200 and only the differences therebetween are described hereinbelow. On of these differences resides in the use of different coupler including a link 629. The link 629 extends between two adjacent ones of the tongues 622 and is secured thereto. For example, the link 629 takes the form of a relatively narrow plate having three link apertures 635 extending vertically therethrough. Two of the link apertures 635 are each in register with a respective one of the tongue coupling apertures 624. The last link aperture 635 is located between the two tongues 622. Two pins 631 are used to secure the link 629 to the tongues 622 by being inserted each through a respective tongue coupling apertures 624 and the link aperture 635 that is in register therewith. The pins 631 may be threaded or not and my be freely slidable or frictionally engage at least one of the tongue coupling apertures 624 and the link aperture 635. The coupler 628 also includes a third pin 633 inserted through the middle link aperture 635, again either freely slidable relative thereto or snugly fitting thereinto. The pin 633 is also inserted through the coupling portion apertures 634 as in the system 200. The pins 631 and 633 may for example include each a stem 637 and be terminated at their to upper end by a wider head 639 to prevent accidental passage through the link aperture 635 and/or coupling portion aperture 634.

The coupling portions 632 may have a generally square configuration. If suitably sized, this configuration may facilitate alignment of the construction blocks 512 (not shown in FIG. 14) with the inter-block element 602, and more specifically with the rear edge 606 thereof. Also, the tongues 622 may merge with the body 603 gradually, along a curved edge, so as to reduce stress concentrations.

Another difference between the system 600 and the system 200 resides in that in the system 600, there are two rows of bonding apertures 618 instead of one. Also, the draining apertures 616 are relatively smaller and spaced apart by a larger distance than in the system 200. The body 603 may also, in some embodiments, include cavities (not shown in FIG. 14) projecting upwardly towards the top surface 610 from the bottom surface 612 to reduce the quantity of material required to manufacture the inter-block element 602.

Figure 15:
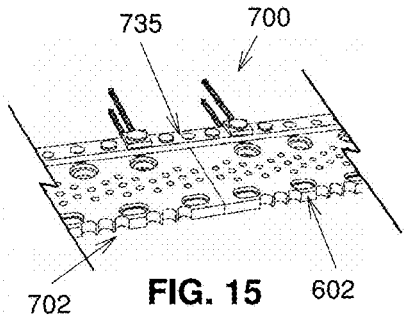
FIG. 15, in a perspective view, illustrates a variant to the system of FIG. 14.

FIG. 15 illustrates yet another system 700 similar to the system 600, except that the link element 735 engages more than two tongues (not visible in FIG. 15) and may even span across more than one inter-block element 702, which advantageously ensures that the inter-block elements 702 are well-aligned during the construction process.

Figure 16:
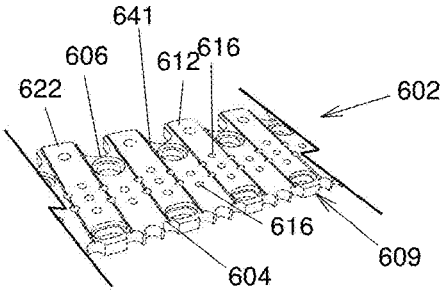
FIG. 16, in an alternative partial perspective view, illustrates an inter-block element part of the system of FIG. 14.

FIG. 16 illustrates the bottom surface 612 of the inter-block element 602. Similar bottom surfaces may be formed in any of the inter-block elements 202, 602 and 702 or horizontal spacing element 102 described in the present document. Instead of being flat, the bottom surface 612 defines draining channels 641 extending therealong in fluid communication with at least one of the draining apertures 616. The draining channels are open at the peripheral edge 609. For example, each draining channel is recessed relative to adjacent portions of the bottom surface 612 and are open at the rear and front edges 606 and 604. In some embodiments, but not necessarily, the draining channels 641 are substantially rectilinear and substantially parallel to each other. The draining channel facilitate evacuation of condensation or of water infiltration from the wall 500.

Figure 17:
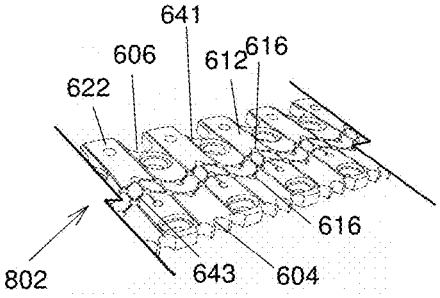
FIG. 17, in an partial alternative perspective view, illustrates an alternative inter-block element usable in the system of FIG. 14.

FIG. 17 illustrates an alternative bottom surface 812 that may replace the bottom surface 612. and differs therefrom in that in addition to the draining channels 641, the bottom surface 812 also includes inter-channel grooves 643 that extend between adjacent ones of the draining channels 641 to allow passage of liquid therethrough. The inter-channel grooves 643 may each be in a fluid communication relationship with at least one additional draining aperture 616 that would not be drained by the draining channels 641 otherwise.

Figure 18:
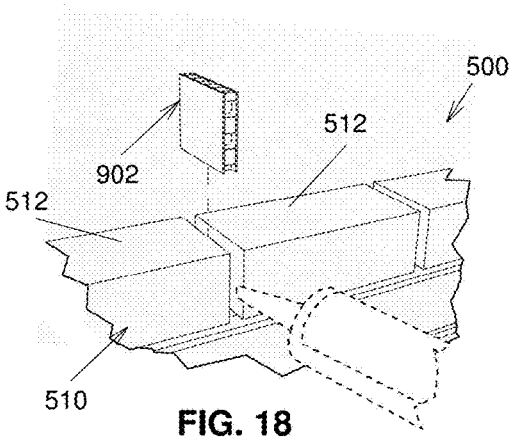
FIG. 18, in a perspective environmental view, illustrates a vertical spacing element usable with the systems and spacing elements of FIGS. 1 to 17.
Figure 19:
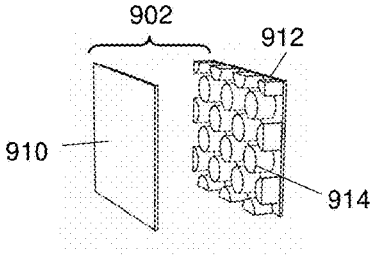
FIG. 19, in a perspective exploded view, illustrates the vertical spacing element of FIG. 18.
Figure 20:
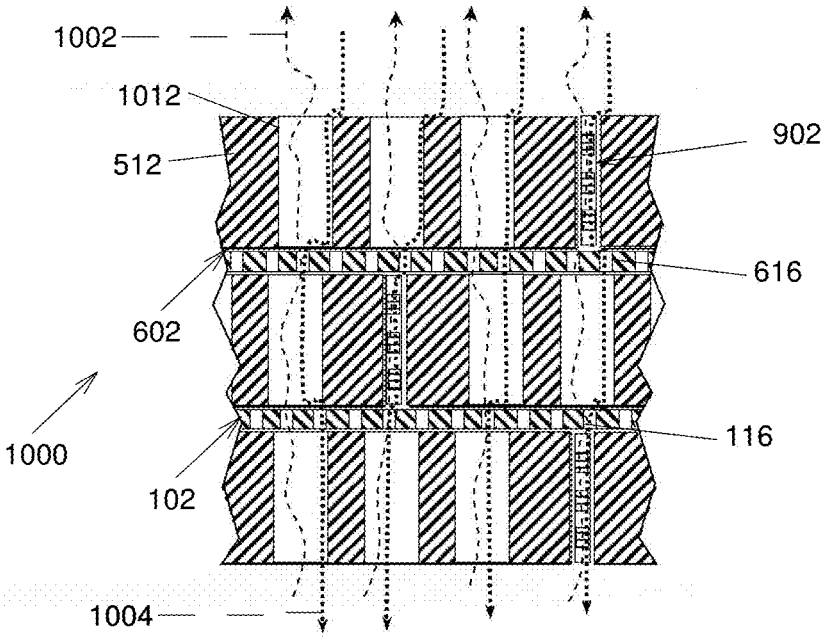
FIG. 20, in a side-cross-sectional view, illustrates a wall incorporating the spacing element of FIG. 18.

FIGS. 18 and 19 illustrate a vertical spacing element 902. As seen in FIG. 18, the vertical spacing element 902 may be used in the wall 500 to replace most of the mortar or other bonding material conventionally inserted between the construction blocks 512 in each row 510. The vertical spacing element 902 may be a bit shorter than the width of the construction blocks 512 to allow the front edge thereof to be covered with the bonding material 520 as are the inter-block and horizontal spacing element front edges 204 and 104. While any suitable vertical spacing element 902 having the right dimensions may be used, FIG. 19 illustrates a specific vertical spacing element 902 having two substantially parallel side walls 910 and 912 interconnected by a plurality of pegs 914. The pegs 914 are distanced from each other so that the space between the side walls 910 and 912 is not completely filled, to allow air circulation and water draining therethrough. FIG. 20 illustrates such air 1002 circulation and water 1004 drainage in a wall 1000 incorporating the vertical spacing elements 902. In FIG. 20, the construction blocks 1010 are of the type including apertures 1012 extending vertically therethrough.

Figure 21:
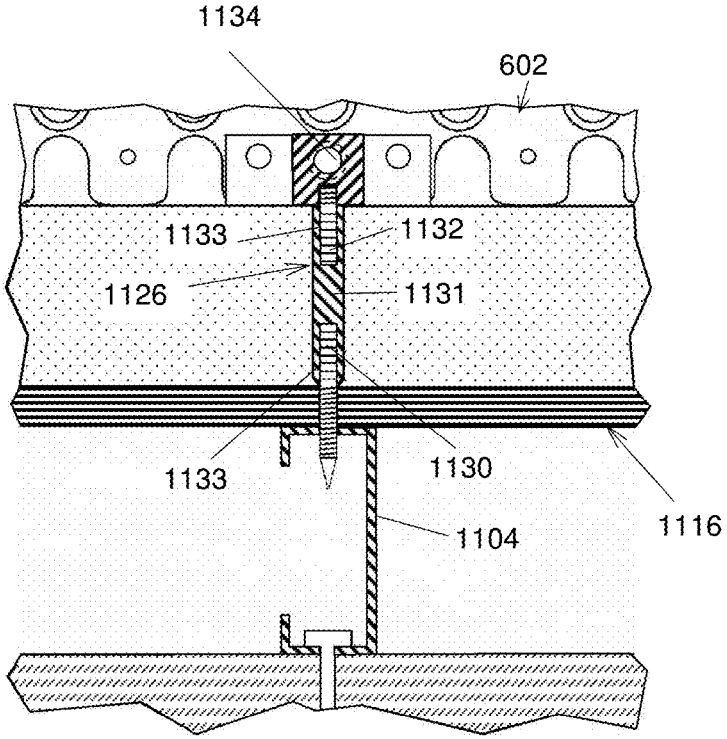
FIG. 21, in an environmental top cross-sectional view, illustrates an anchor and coupler usable with the inter-block elements of FIGS. 1 and 8.

FIG. 21. illustrates an alternative anchor element 1126 usable in any of the above-describes systems. The anchor element 1126 is usable, for example, in embodiments in which the anchor element 1126 needs to contact two different materials, or in which the anchor element 1126 needs to have parts thereof made of two different materials. Indeed, in some embodiments, it may be advantageous to manufacture any metallic part of the systems 200 and 600 that outside of the adjacent structure 1116, to have better resistance to corrosion. However, many adjacent structures 1116 to which the system 200 and 600 are attached may include galvanized steel studs 1104 in which the anchor elements 1126 are screwed. In such embodiments, and in others, it is particularly advantageous to use anchor elements 1126 incorporating two different materials as described hereinbelow.

More specifically, FIG. 21 illustrates an anchor element 1126 including anchoring and coupling portions 1130 and 1132 made of different metals having different galvanic potentials. For example, the anchoring and coupling portions 1130 and 1132 are made respectively of galvanized steel and stainless steel. The anchor element 1126 further includes an intermediate portion 1131 provided between the anchoring and coupling portions 1130 and 1132, the intermediate portion 1131 separates the anchoring and coupling portions from each other so that they are not in contact with each other. For example, the intermediate portion 1131 is electrically insulating so that no current can flow therethrough between the two materials having different galvanic potentials. For example, the intermediate portion 1131 is made of a polymer. The anchoring and coupling portions 1130 and 1132 may be threaded and screwed in intermediate portion threaded apertures 1133 each extending into the intermediate portion 1131 axially aligned with each other, but disjoint from each other. In some embodiments, the anchoring portion 1130 is self-piercing opposed to the intermediate portion 1131 so as to be relatively easily securable to the stud 1104. The coupling portion 1132 defines a coupling portion aperture 1134, as in the anchor elements 226 and 626. Therefore, in such embodiments, galvanic corrosion that would occur by screwing a stainless steel component in the galvanized steel stud 1104 is prevented.

Although the present invention has been described hereinabove by way of exemplary embodiments thereof, it will be readily appreciated that many modifications are possible in the exemplary embodiments without materially departing from the novel teachings and advantages of this invention. Accordingly, the scope of the claims should not be limited by the exemplary embodiments, but should be given the broadest interpretation consistent with the description as a whole. The present invention can thus be modified without departing from the spirit and nature of the subject invention as defined in the appended claims.

What is claimed is:

1. A system for anchoring a wall including superposed rows of construction blocks to an adjacent upstanding structure, each row including a plurality of the construction blocks, the system comprising:

an inter-block element insertable between adjacent ones of the construction blocks and securable thereto; and an anchor including an anchoring portion securable to the upstanding structure and a coupler, the coupler securing the anchor and the inter-block element to each other with the anchoring portion at a predetermined distance from the inter-block element and such that with the anchoring portion operatively secured to the upstanding structure and the inter-block element operatively inserted between the adjacent ones of the construction blocks and secured thereto, the anchoring portion and the inter-block element are movable vertically relative to each other over a predetermined range of motion with the anchor remaining secured to the inter-block element;

wherein the inter-block element is substantially plate-shaped and defines opposed top and bottom surfaces and a peripheral edge, the inter-block element defining draining apertures extending between the top and bottom surfaces spaced apart from the peripheral edge.

2. The system as defined in claim 1, wherein the anchor includes an anchoring element, the anchoring portion being part of the anchoring element, the anchoring element including a coupling portion opposed to the anchoring portion, the coupler being removably secured to the coupling portion.

3. The system as defined in claim 2, wherein the anchoring and coupling portions are made of different metals having different galvanic potentials, the anchor element further comprising an intermediate portion provided between the anchoring and coupling portions separating the anchoring and coupling portions from each other.

4. The system as defined in claim 1, wherein the inter-block element defines a body and a tongue protruding from the body, the tongue defining a tongue coupling aperture extending therethrough between the top and bottom surfaces, and wherein, with the inter-block element operatively inserted between adjacent ones of the construction blocks and operatively secured thereto, the body is inserted between the adjacent ones of the construction blocks and the tongue protrudes from the adjacent ones of the construction blocks, the coupler being inserted through the tongue coupling aperture.

5. The system as defined in claim 4, wherein the coupler is vertically slidable relative to the tongue coupling aperture.

6. The system as defined in claim 5, wherein the coupling portion defines a vertically extending coupling portion aperture and the coupler includes a stem extending substantially vertically downwardly from a head, the stem being inserted in the coupling portion aperture and slidably inserted through the tongue coupling aperture, the head being larger than the coupling portion aperture and the head being above the coupling portion aperture.

7. The system as defined in claim 6, wherein the coupling portion aperture is threaded, the coupling portion aperture and the tongue coupling aperture being vertically aligned relative to each other, the stem being threaded, the stem threadedly engaging the coupling portion aperture and the stem being slidable along the tongue coupling aperture.

8. The system as defined in claim 1, wherein the inter-block element defines a body and at least two tongues protruding from the body in a spaced apart relationship relative to each other, the coupler including a link secured to the two tongues and defining a link aperture extending vertically therethrough between the two tongues, wherein, with the inter-block element operatively inserted between adjacent ones of the construction blocks and operatively secured thereto, the body is inserted between the adjacent ones of the construction blocks and the tongues and link protrude from the adjacent ones of the construction blocks, the coupler including a stem extending substantially vertically downwardly from a head, the stem being inserted in the coupling portion aperture and through the link aperture, the head being larger than the link aperture and the head being above the link.

9. The system as defined in claim 1, wherein the inter-block element defines at least one bonding aperture extending between the top and bottom surface spaced apart from the peripheral edge for inserting a bonding material thereinto to bind the two adjacent ones of the construction blocks to each other with the inter-block element therebetween.

10. The system as defined in claim 9, wherein the bonding aperture defines a neck at a location intermediate the top and bottom surfaces.

11. The system as defined in claim 1, wherein at least part of the peripheral edge is corrugated.

12. The system as defined in claim 1, wherein the anchoring portion is threaded and screwable to the adjacent structure.

13. The system as defined in claim 1, wherein the bottom surface defines draining channels extending therealong in fluid communication with at least one of the draining apertures.

14. A building, comprising:

an upstanding structure defining a substantially vertical upstanding structure face; and a wall made of superposed rows of construction blocks erected substantially parallel to the upstanding structure face, the wall including a plurality of rows, each row including a plurality of construction blocks, the wall including an inter-block element inserted between two adjacent ones of the construction blocks, each in a respective one of the rows, and secured thereto; and an anchor including an anchoring portion secured to the upstanding structure and a coupler, the coupler securing the anchor and the inter-block element to each other with the anchoring portion at a predetermined distance from the inter-block element;

wherein the anchoring portion and the inter-block element are movable vertically relative to each other over a predetermined range of motion with the anchor remaining secured to the inter-block element;

wherein the inter-block element is substantially plate-shaped and defines opposed top and bottom surfaces and a peripheral edge, the inter-block element further defining draining apertures extending between the top and bottom surfaces spaced apart from the peripheral edge and the bottom surface defining draining channels extending therealong in fluid communication with at least one of the draining apertures;

whereby condensation forming in the wall and water infiltrations in the wall are evacuated therefrom through the draining apertures and draining channels.

15. The building as defined in claim 14, wherein the anchor includes an anchoring element, the anchoring portion being part of the anchoring element, the anchoring element including a coupling portion opposed to the anchoring portion, the coupler being secured to the coupling portion; and the inter-block element defining also a body and a tongue protruding from the body, the tongue defining a tongue coupling aperture extending therethrough between the top and bottom surfaces, the body being inserted between the rows and the tongue protruding from the wall between the wall and the upstanding structure face, the coupler being inserted through the tongue coupling aperture and vertically slidable relative thereto.

16. The building as defined in claim 15, wherein the coupling portion defines a vertically extending coupling portion aperture and the coupler includes a head and a stem extending substantially vertically downwardly from the head, the stem being inserted in the coupling portion aperture, the head being larger than the coupling portion aperture.

17. The building as defined in claim 15, wherein the body defines at least one bonding aperture extending vertically therethrough spaced apart from the peripheral edge, the wall further comprising a bonding material in the at least one bonding aperture, the bonding material being bound to the two adjacent ones of the construction blocks.

18. The building as defined in claim 14, wherein the wall includes a plurality of the inter-block elements and a plurality of horizontal and vertical spacing elements provided between the construction blocks, the inter-block elements and the horizontal and vertical spacing elements having a front end that is short of a front surface of the wall, the wall also including a bonding material provided in front of the inter-block elements and the horizontal and vertical spacing elements between the construction blocks.

19. The building as defined in claim 14, wherein the wall is devoid of mortar between the construction blocks.

* * * * *